US005834713A

United States Patent [19]

Huang

[11] Patent Number: 5,834,713

[45] Date of Patent: Nov. 10, 1998

[54] FRESH AIR SUPPLYING SYSTEM FOR ELEVATOR

[76] Inventor: Hsin-Tsung Huang, P.O. Box 55-175, Taichung, Taiwan

[21] Appl. No.: 818,301

[22] Filed: Mar. 14, 1997

[51] Int. Cl.[6] ..... B66B 7/00; F24F 7/00

[52] U.S. Cl. ..... 187/391; 187/414; 454/68; 454/195

[58] Field of Search ..... 187/391, 390, 187/413, 414; 454/68, 195

[56] References Cited

U.S. PATENT DOCUMENTS 3,687,052 8/1972 Schonberg ..... 98/32
3,817,161 6/1974 Koplon ..... 98/39
4,592,270 6/1986 Vener ..... 98/39.1
5,718,627 2/1998 Wicks ..... 454/68

*Primary Examiner*—Robert Nappi

[57] ABSTRACT

An air supply system may supply air into an elevator building and into the elevator. The system includes a number of frames each having a number of openings communicating with an air passage formed in the elevator building. One or more tubes are disposed in the elevator building for communicating with the air passage. An air generator is coupled to the tube for supplying air into the tube and for supplying air into the air passage and the elevator. A heat resistive panel assembly is secured to the wall and spaced from the elevator for forming an air chamber and for protecting the elevator from being burned by the fire.

2 Claims, 4 Drawing Sheets

FRESH AIR SUPPLYING SYSTEM FOR ELEVATOR

BACKGROUND OF THE INVENTION

1. Field of the Invention

The present invention relates to a fresh air supplying system, and more particularly to a fresh air supplying system for an elevator.

2. Description of the Prior Art

Typical elevators comprise a fan device provided on top thereof for circulating the air in the elevator and for drawing the air into the building for receiving the elevator. However, the air in the elevator building is closely received in the elevator building and may not be circulated with that in the outer environment. The air may be polluted after long term of usage. When the elevator is stopped for some reasons, no fresh air may be supplied into the elevator such that the user may feel uncomfortable. Particularly, when fire happens and when the elevator is stopped, no fresh air may be supplied into the elevator such that the persons stayed in the elevator have to wait to die.

The present invention has arisen to mitigate and/or obviate the afore-described disadvantages of the conventional elevators.

SUMMARY OF THE INVENTION

The primary objective of the present invention is to provide a fresh air supplying system for supplying fresh air into the elevator.

The other objective of the present invention is to provide a fresh air supplying system for supplying fresh air to the front door of the elevator for allowing the user to breath fresh air during the fire.

The further objective of the present invention is to provide a fresh air supplying system, in which the elevator is enclosed by a partition member and an air inlet is provided in the bottom portion of the elevator building for supplying fresh air into the elevator.

The still further objective of the present invention is to provide a fresh air supplying system which may supply fresh air to the front door of the elevator for facilitating the fire fighters to evacuating the persons.

In accordance with one aspect of the invention, there is provided an air supply system for supplying air into an elevator building and into at least one elevator, the system comprises a plurality of frames each including a peripheral surface having a plurality of openings formed therein, a plate for securing to a wall of the elevator building and for forming an air passage, the air passage being communicating with the openings of the frames, at least one tube for disposing in the elevator building and for communicating with the air passage, all air generator for disposing in a bottom portion of the elevator building, the air generator being coupled to the tube for supplying air into the tube and for supplying air into the air passage, and a heat resistive panel assembly for securing to the wall of the elevator building, the panel assembly being spaced from the elevator for forming an air chamber and spaced from the wall of the elevator building for forming an air room.

The panel assembly includes a plurality of panels secured together and secured to the wall of the elevator building by a plurality of stays.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
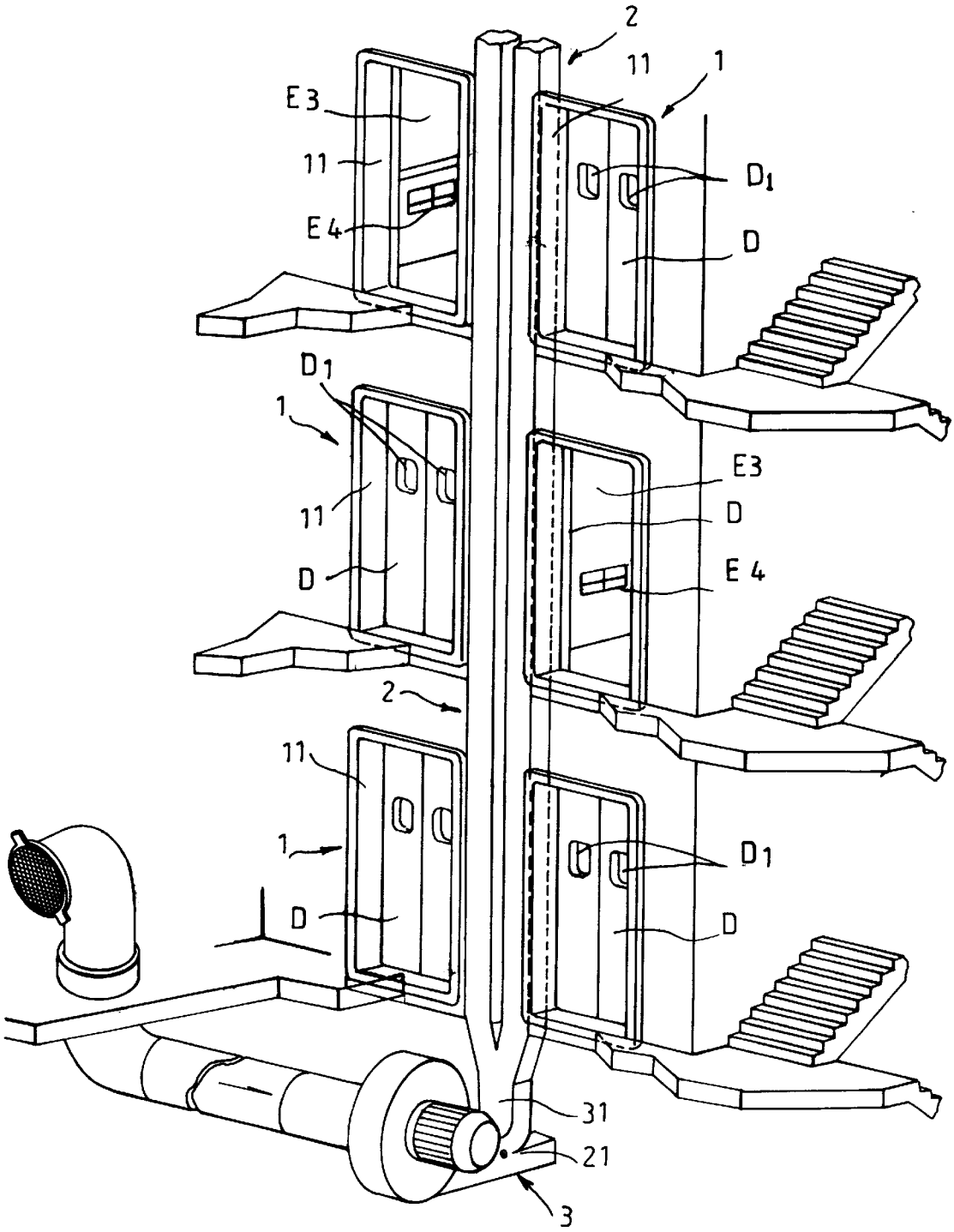
FIG. 1 is a perspective view of a fresh air supplying system in accordance with the present invention.
Figure 2:
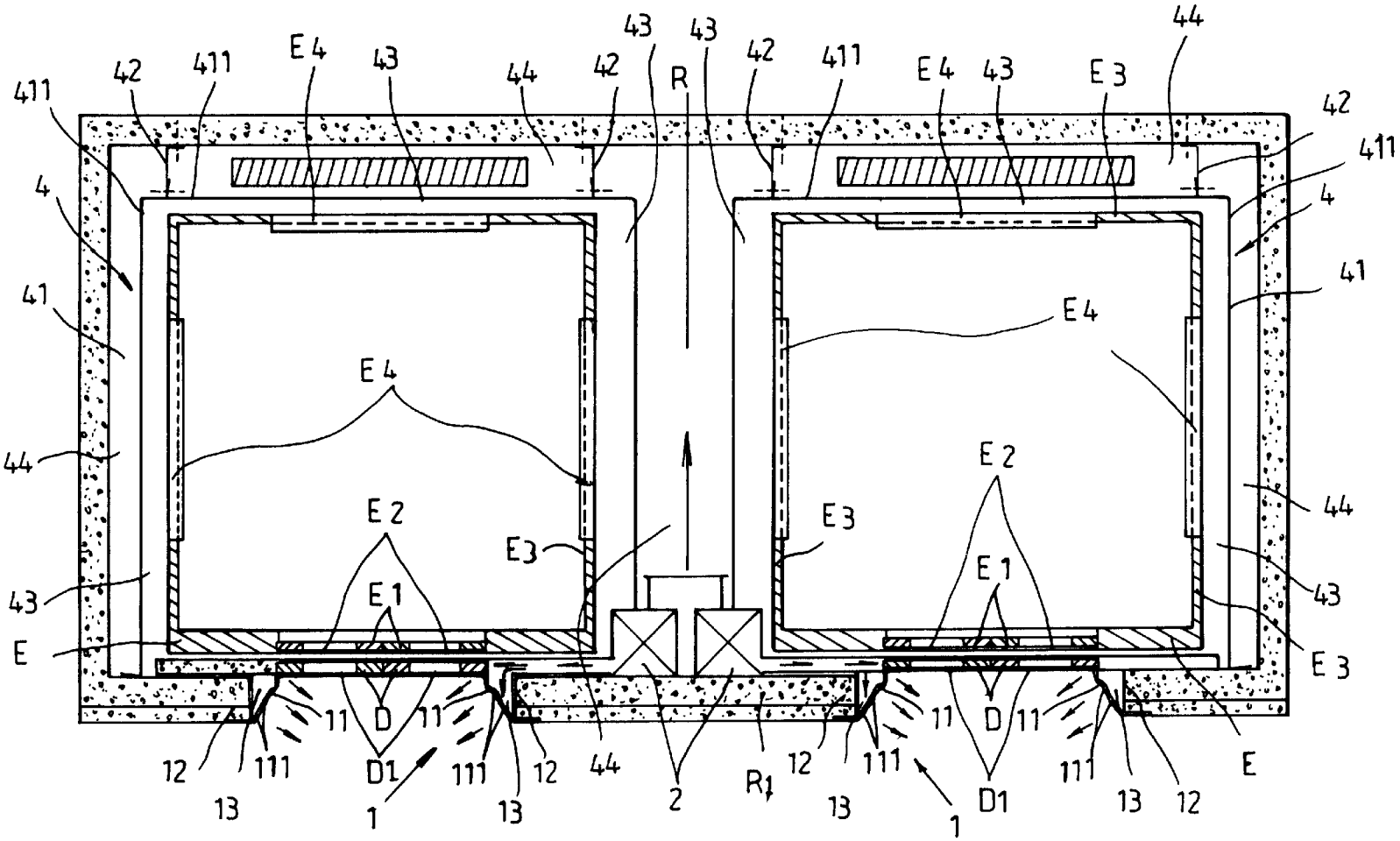
FIG. 2 is a lateral cross sectional view of the fresh air supplying system.

Referring to the drawings, a fresh air supplying system in accordance with the present invention is mainly provided for supplying fresh air into the elevator and/or for supplying fresh air to the front portion of the elevator E. The elevator system includes one or more frames 1 provided in each floor. The frames 1 each comprises a peripheral surface 11 having a number of openings 111 (FIG. 2). A plate 12 is secured to the wall R1 of the elevator building for forming a passage 13 which is communicating with one or more tubes 2 provided vertically in the wall R1 of the elevator building. The elevator building includes a passageway R for slidably receiving one or more elevators E.

Figure 4:
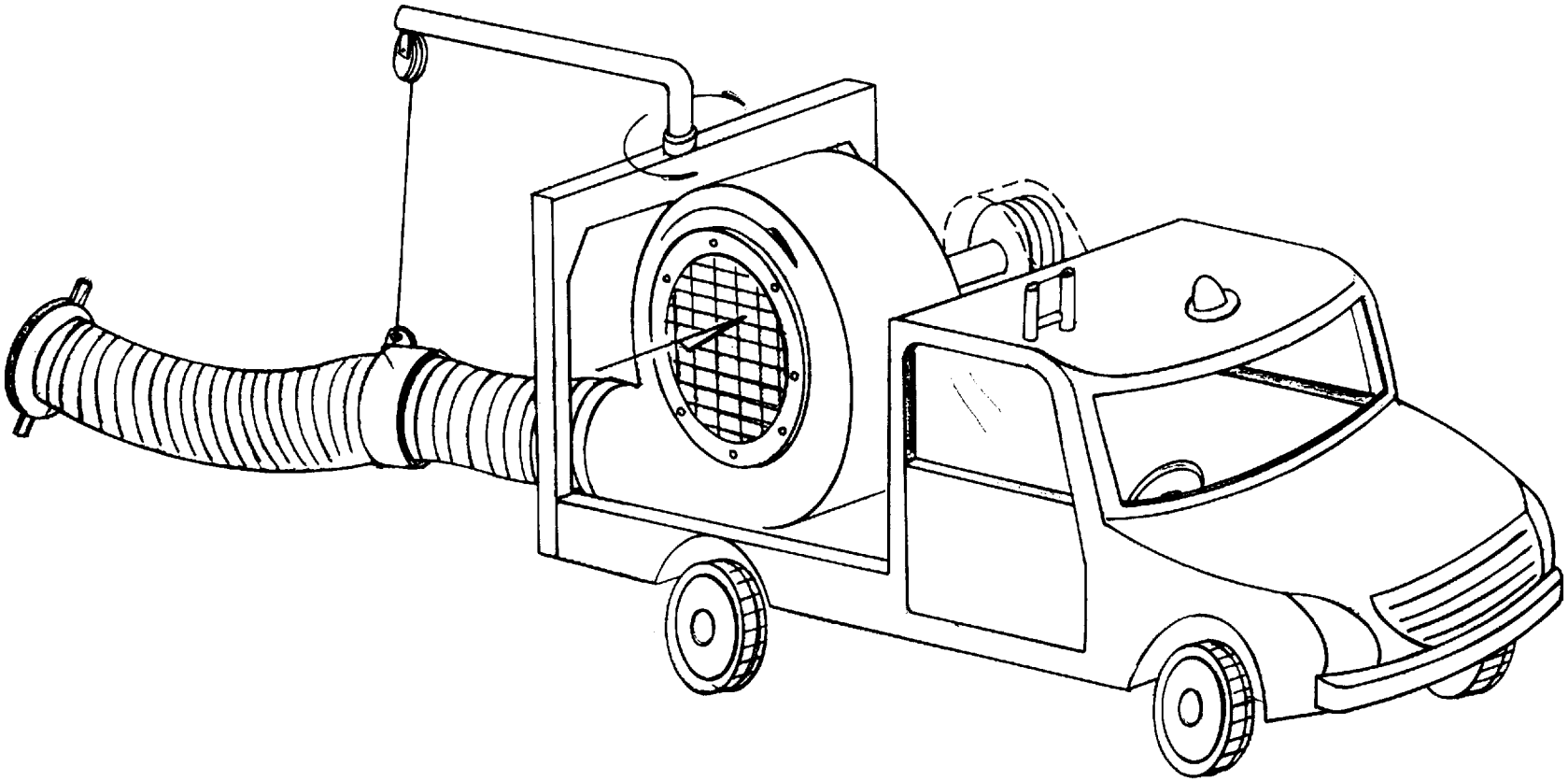
FIG. 4 is a perspective view showing the air supplier device.

An air generator 3 includes an outlet 31 coupled to the tubes 2 for supplying air into the passages 13 and for supplying air out through the openings 111. The air generator 3 includes an air inlet conduit 32 having a filter 33 secured to the inlet opening for filtering the air and for supplying fresh air into the passages 13. The air generator 3 includes a pressure adjusting valve 21 which may be switched to be energized by battery or other electricity generator. The valve 21 allows the air supplier of the fire brigade to be coupled to the tubes 2 for allowing other air supplier to supply fresh air into the tubes 2. One example of the air supplier is shown in FIG. 4.

A heat resistive panel assembly 4 includes a number of panels 41 secured together and secured in place by stays 42 which are secured to the wall R1 of the elevator building and which will not affect the operation of the elevator E. The panels 41 each includes a number of segments secured together and are spaced from the elevator E for a suitable distance and for forming an air chamber 43. The panels 41 are also spaced away from the wall R1 for a distance so as to form an air room 44 between the panels 41 and the wall R1. The panels 41 extend upward toward the floor M1 of the upper room M which is provided for receiving the motor or other mechanical facilities.

The elevator system includes a door D provided in each floor and each having transparent window D1. The elevators E each also includes a door E1 having a window E2 for aligning with the window D1. The elevator E each includes three walls E3 each having a shutter E4 for air circulation purposes. The elevators E each includes a fan device E5 provided on top thereof.

Figure 3:
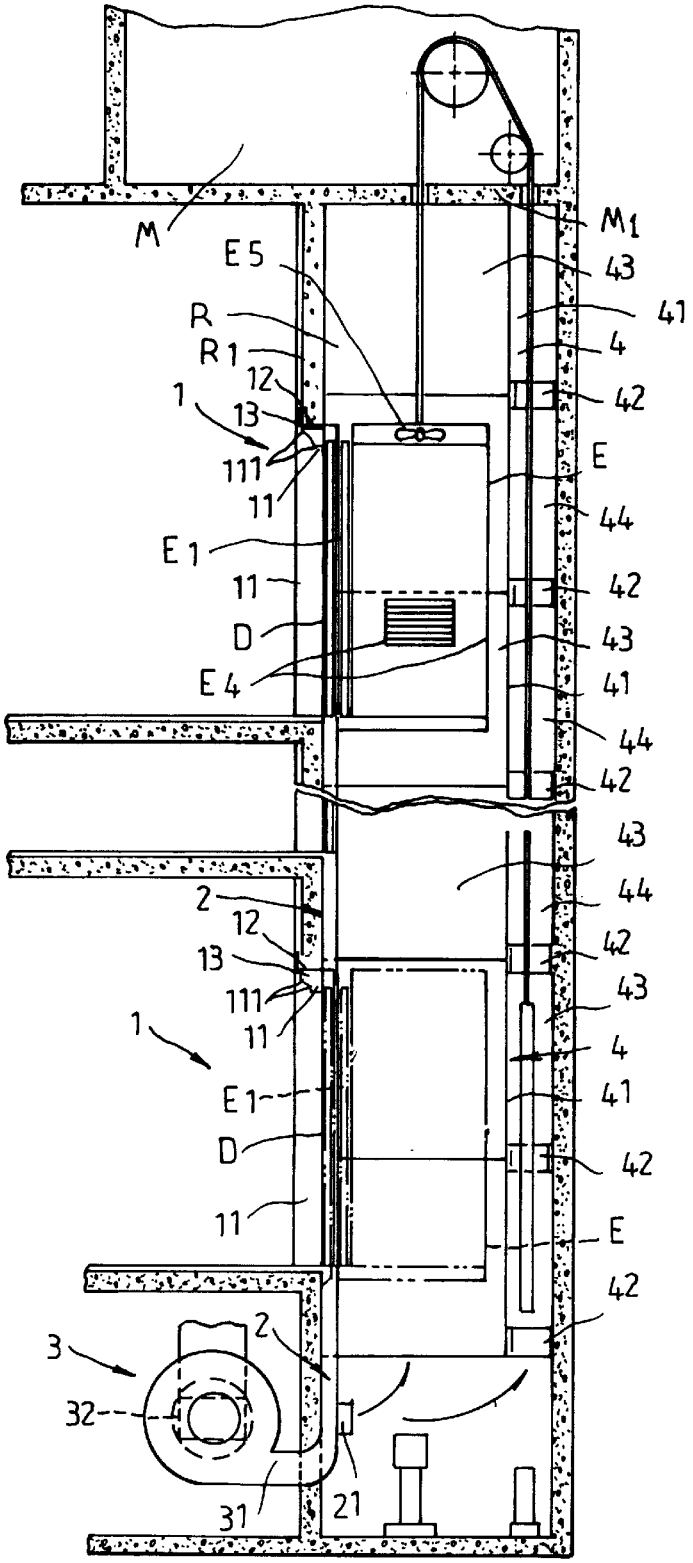
FIG. 3 is a longitudinal cross sectional view of the fresh air supplying system.

In operation, the air generator 3 may drawing fresh air from outer environment into the tubes 2 and the manifolds 21 (FIG. 3), and for supplying fresh air into the frames 1 and the air chambers 43. The fresh air may thus be supplied into the elevators E via the shutters E4. The fan device E5 may facilitate the air circulating effect. The fresh air supplied into the air chambers 43 may also prevent the fire from entering into the passageway R. In addition, the panels 41 and the air rooms 44 may also be used for protecting the elevators E and for preventing the people in the elevator to be burned by the fire.

Accordingly, the fresh air supplying system in accordance with the present invention may supply fresh air into the elevator and to the front portion of the elevator. In addition, the air may also be supplied to the air chamber around the elevator for preventing the elevator from being burned by the fire. The panels may also be used for protecting the elevator.

Although this invention has been described with a certain degree of particularity, it is to be understood that the present disclosure has been made by way of example only and that numerous changes in the detailed construction and the combination and arrangement of parts may be resorted to without departing from the spirit and scope of the invention a hereinafter claimed.

I claim:

1. An air supply system for supplying air into an elevator building and into at least one elevator, said system comprising:

a plurality of frames each including a peripheral surface having a plurality of openings formed therein, a plate for securing to a wall of the elevator building and for forming an air passage, said air passage being communicating with said openings of said frames, at least one tube for disposing in said elevator building and for communicating with said air passage, an air generator for disposing in a bottom portion of the elevator building, said air generator being coupled to said tube for supplying air into said tube and for supplying air into said air passage, and a heat resistive panel assembly for securing to the wall of the elevator building, said panel assembly being spaced from the elevator for forming an air chamber and spaced from the wall of the elevator building for forming an air room.

2. The air supply system according to claim 1, wherein said panel assembly includes a plurality of panels secured together and secured to the wall of the elevator building by a plurality of stays.

* * * * *